United States Patent [19]

Matsuda et al.

[11] 4,122,314

[45] Oct. 24, 1978

[54] LOUDSPEAKER HAVING A LAMINATE DIAPHRAGM OF THREE LAYERS

[75] Inventors: Atsushi Matsuda, Tokyo; Jun Kishigami, Urawa; Masaaki Nishimura, Tokyo, all of Japan

[73] Assignee: Sony Corporation, Tokyo, Japan

[21] Appl. No.: 863,426

[22] Filed: Dec. 22, 1977

[30] Foreign Application Priority Data

Dec. 23, 1976 [JP] Japan ..... 51-155239

[51] Int. Cl.[2] ..... H04R 7/10; H04R 7/20; H04R 9/06

[52] U.S. Cl. ..... 179/115.5 R; 181/170; 181/172

[58] Field of Search ..... 179/115.5 R, 181 R, 179/181 F; 181/167, 170

[56] References Cited

U.S. PATENT DOCUMENTS

| | | | |
|---|---|---|---|
| 630,246 | 12/1899 | Husted et al. | 179/181 R |
| 953,970 | 4/1910 | Noble | 179/181 R |
| 1,459,803 | 1/1923 | Steurer | 179/181 R |
| 1,570,337 | 1/1926 | Cook | 179/181 R |
| 1,639,656 | 8/1927 | Kersten | 181/170 |
| 1,639,713 | 8/1927 | Sykes | 179/115.5 R |
| 1,702,926 | 2/1929 | Bartsch et al. | 181/170 |
| 1,705,771 | 3/1929 | Kimball | 181/170 |
| 1,721,625 | 7/1929 | Hartman | 179/181 R |
| 1,723,550 | 8/1929 | Kitto | 179/181 R |
| 1,740,651 | 12/1929 | Hueter | 181/170 |
| 1,768,473 | 6/1930 | Gaty | 181/170 |
| 1,852,064 | 4/1932 | Sykes | 179/115.5 R |
| 1,952,357 | 3/1934 | Blumlein et al. | 179/115.5 R |
| 2,006,453 | 7/1935 | Harrison | 181/170 |
| 3,060,282 | 10/1962 | Duncan | 179/181 R |
| 3,093,207 | 6/1963 | Bozak | 181/167 |
| 3,111,187 | 11/1963 | Barlow | 181/170 |
| 3,125,647 | 3/1964 | Rouy | 179/115.5 R |
| 3,347,335 | 10/1967 | Watters et al. | 179/181 R |
| 3,674,109 | 7/1972 | Murase | 181/170 |
| 3,834,486 | 9/1974 | Tsuge et al. | 181/170 |
| 3,858,680 | 1/1975 | Tsuge et al. | 181/167 |
| 4,020,299 | 4/1977 | Garner et al. | 179/181 R |
| 4,029,171 | 6/1977 | Manger | 181/170 |

FOREIGN PATENT DOCUMENTS

| | | | |
|---|---|---|---|
| 584,932 | 2/1925 | France | 179/181 R |
| 588,096 | 4/1925 | France | 179/181 R |
| 634,878 | 3/1928 | France | 179/181 R |
| 2,274,194 | 2/1976 | France | 179/115.5 VC |
| 217,579 | 1926 | United Kingdom | 179/181 R |
| 240,425 | 4/1926 | United Kingdom | 179/115.5 R |
| 320,654 | 10/1928 | United Kingdom | 179/115.5 R |
| 321,430 | 11/1929 | United Kingdom | 179/115.5 R |
| 1,003,608 | 9/1965 | United Kingdom | 181/167 |
| 1,260,116 | 1/1972 | United Kingdom | 179/181 R |
| 1,275,158 | 5/1972 | United Kingdom | 181/170 |

*Primary Examiner*—George G. Stellar
*Attorney, Agent, or Firm*—Lewis H. Eslinger; Alvin Sinderbrand

[57] ABSTRACT

A loudspeaker having a diaphragm including first and second layers and a core sandwiched between the layers, the core being firmly secured to the inner surface of each layer so as to form a unitary structure therewith, a drive assembly causes the diaphragm to vibrate in accordance with a varying electrical input signal fed thereto, and a support is provided for supporting the diaphragm and drive assembly. The layers are formed of materials through which the velocity of propagation of a longitudinal wave is greater than 5000 m/sec, and the core is formed of materials having a shearing elastic modulus Gco which exceeds the value $$G_{co} > \frac{12\,E_f t_f (t_c + 2t_f)}{l^2}$$

where $E_f$ is the longitudinal elasticity of each of the layers,
$t_f$ is the thickness of each of the layers,
$t_c$ is the thickness of the core, and
$l$ is the length across the surface of the diaphragm.

14 Claims, 21 Drawing Figures

LOUDSPEAKER HAVING A LAMINATE DIAPHRAGM OF THREE LAYERS

BACKGROUND OF THE INVENTION

1. Field of the Invention

The present invention relates generally to a loudspeaker, and, more particularly, to a loudspeaker having a diaphragm of novel construction.

2. Description of the Prior Art

In general, a speaker unit has an electro-mechanical converter, for example, a voice coil driven by an electrical input signal, to vibrate a diaphragm which is connected to the voice coil. In order to maintain a relationship between sound pressure and frequency, that is, the sound-pressure/frequency characteristic, it is necessary that the speaker be driven within a limited so-called piston vibration region. That is, if the speaker is driven at a frequency higher than the critical value of the piston vibration region, a so-called divided vibration is produced, whereby the sound quality is deteriorated. For this reason, in order to improve the sound-pressure/frequency characteristic of a speaker unit, the prior art has attempted to increase the critical value of the piston vibration region. The problem of divided vibration will be described with respect to a plane diaphragm (e.g. vibrating plate).

In the phenomenon of divided vibration, there are various kinds of vibration modes; and the frequencies at which the respective modes of divided vibrations occur are different and are dependent upon the particular vibration modes. For example, if the plane diaphragm is circular, the frequency $f_{nm}$ at which each mode of divided vibration occurs is expressed as:

$$f_{nm} = \frac{\lambda 2_{nm}}{2\pi a^2}\sqrt{\frac{D}{\sigma}} \tag{1}$$

where $a$ is the radius of the circular vibrating diaphragm, $D$ is the flexural rigidity of the vibrating diaphragm, $\sigma$ is its surface density of the diaphragm and $\lambda^2$ nm is a factor of the $(n, m)$ mode. If $n=0$, then the $(0,m)$mode $(m = 0, 1, 2 \ldots)$ is a divided vibration which is present in a prior art coneshaped diaphragm.

As may be apparent from equation (1), the divided vibration frequency $f_{nm}$ will be high if the flexural ridigity D of the diaphragmn is large and/or if the radius $a$ and/or the surface density $\sigma$ of the diaphragm are small. However, the radius $a$ usually is preselected in accordance with other considerations to be a desired value. Accordingly, the critical value of the divided vibration frequency of the diaphragm is determined primarily by its flexural rigidity and surface density $\sigma$.

Now, a plane plate of isotropic material will be considered. The flexural rigidity D and surface density of the plate may be expressed as:

$$D = \frac{Et^3}{12(1-\nu^2)}\ ;\ \sigma = \rho t \tag{2}$$

where $E$ is the longitudinal elastic modulus of the material of which the plate is constructed, $\nu$ is Poisson's ratio, $t$ is the thickness of the plate and $\rho$ is its volume density. From equation (2), the term $D/\sigma$ in the right side of equation (1) can be expressed as follows:

$$\frac{D}{\sigma} = \frac{Et^2}{12(1-\nu^2)\rho} \tag{3}$$

Since the poisson's ratio $\nu$ is within a range of 0.1 to 0.5, it has only a minimal effect on the term $D/\sigma$.

A typical speaker having a plane plate type diaphragm is made of beryllium, for example. Beryllium is known to have the highest $^E/\rho$ factor. One type of speaker unit has a diameter of 30cm, and the effective diameter of the diaphragm thereof is 24cm. If the diaphragm is formed as a disc having a diameter of 24cm, its mass may be selected to be 30g (for the purpose of efficiency), its surface density $\sigma$ may be selected to be 0.663 kg/cm$^2$ and its thickness may be selected to be 0.36 mm (with Poisson's ratio $\nu$ equal to 0.3). From equation (1), the frequency $f_{2,0}$ at which lowest (2, 0) mode in the divided vibration appears is calculated to be $f_{2.0} = 77.1$ H$_z$. This low value of the divided vibration frequency means that the critical value of the piston vibration is 77.1 H$_z$, thus making such a speaker unit impractical. In order to drive the diaphragm, a voice coi and associated means must be attached to the diaphragm, and their cumulative mass affects the divided vibration frequency value, so that the frequency is further decreased. Accordingly, it is appreciated that a general plane plate of isotropic material will not perform satisfactorily as a speaker unit.

In view of the foregoing, a complex diaghragm has been proposed wherein a layer of aluminum alloy is secured to opposing surfaces of a core made of styrene foam. As a practical example, an aluminum alloy film having a thickness of 30$\mu$ (micron) is employed as the layer and styrene foam having a thickness of 12 mm is used as the core. The effective diameter of the diaphragm is selected to be 24 cm, the mass of the diaphragm (including a mass of $9_g$ of the adhesive agent) is selected to be 29.1g, and the mass of the voice coil is selected to be $7.5_g$. The density $\rho f$ of each layer is 2690 kg/m$^3$, the density $\rho$ c of the core is 23.5 Kg/m$^3$, the longitudinal elastic modulus $E_f$ of each layer is $7 \times 10^{10}$ N/M$^2$, and the shearing elastic modulus $G_c$ of the core is $3.5 \times 10^6$N/m$^2$. The equivalent flexural rigidity D of this complex diaphragm, formed as a plate with a beam taken as $l$, is expressed by the equation below. In this example, the thickness $t_f$ of the layers on both surfaces of the core is assumed to be equal.

When the complex diaphragm is made by sandwiching a core between two layers, and a pressure P is applied to this diaphragm from one layer, the distortion factor $\delta_s$ of the layer is expressed as:

$$\delta_s = \frac{Pl^3}{24t_f^2bE_f}$$

and the distortion factor $\delta_c$ of the core is expressed as:

$$\delta_c = \frac{Pl}{2bt_cG_c}$$

where P is the applied pressure, $l$ is the length of the beam, $t_f$ the thickness of a layer, $t_c$ is the thickness of the core, $t$ is the thickness of the complex plate (equal to $2t_f+t_c$), $b$ is the width of the diaphragm, $E_f$ is the longitudinal elastic modulus of a layer, and $G_c$ is the shearing elastic modulus of the core.

For a simple diaphragm, its distortion factor $\delta$ is expressed as:

$$\delta = \frac{Pl^3}{48\,bD}$$

where D is the flexural rigidity of the diaphragm.

If the following equivalency is established, $$\delta = \delta_s + \delta_c$$

then the equivalent flexural rigidity D is approximately:

$$D = \frac{E_f G_c t_f^2 l^2}{2G_c l^2 + 24E_f t_f t} \quad (4)$$

The surface density $\sigma$ for this complex diaphragm may be $$\sigma = \rho_c t_c + 2\,\rho_f t_f \quad (5)$$

where, it is recalled $\rho_c$ is the density of the core and $\rho_f$ is the density of each layer.

Accordingly, the equivalent flexural rigidity of this complex diaphragm of the prior art, in which the core is made of styrene foam and each layer is made of aluminum alloy, is derived from equation (4) to be 60.9N.m (the shearing elastic modulus $G_c$ of the core being $3.5 \times 10^6$ N/cm$^2$). Thus, if the equivalent flexural rigidity D calculated from equation (4) and the surface density $\sigma$ calculated from equation (5) are substituted into the equation (1), the divided vibration frequencies are calculated to be $f_{0,1} \approx 680$H$_z$ and $f_{0,2} \approx 1.8$ KH$_z$, respectively.

The critical value of the piston vibration region obtained by the prior art complex diaphragm plate is about 680 H$_z$. Although this is an improvement over the region obtained by a cone speaker of the same size, the value still is not satisfactory. One of the reasons for the limitation on the piston vibration region is that the shearing elastic modulus $G_c$ of the core is considerably low.

Another example of a vibrating plate diaphragm used in a board-speaker, is a complex diaphragm in which two paper liners sandwich a honey-comb core between them (for example, laid-open Japanese Patent Application No. 64417/1974). This complex diaphragm may be considered to be a vibrating plate which is used in a panel-type speaker in which the tablet of the panel, which may be ornamental or may have a picture or photograph also is the vibrating plate. In this example, the density $\rho_f$ of the paper liner having a thickness of 0.1 mm is 800 Kg/m$^3$ and the density of the honey-comb core having a thickness of 12 mm is 25.6 Kg/m$^3$. The longitudinal elastic modulus $E_f$ of the paper liner is $3 \times 10^9$ N/m$^2$ and the shearing elastic modulus $G_c$ of the honey-comb core is $4.1 \times 10^7$ N/m$^2$. If the other parameters, such as length $l$, are to be substantially the same as those mentioned above in the foregoing example, then the divided vibration frequencies are calculated from equations (1), (4) and (5) to be $f_{0,1} \approx 435$ H$_z$ and $f_{0,2} \approx 1.1$ KH$_z$, respectively.

The acoustic qualities of the above prior art complex diaphragms, with respect to various characteristics such as frequency characteristic, directional characteristic and the like, are less than satisfactory, and can be significantly improved.

OBJECTS OF THE INVENTION

It is, therefore, an object of the present invention to provide a loudspeaker with an improved vibrating diaphragm which avoids the aforenoted defects of the prior art.

It is another object of the invention to provide a loudspeaker with an improved complex diaphragm in which the critical value of the piston vibration range thereof is increased as compared to the prior art diaphragms.

It is a further object of the invention to provide a loudspeaker whose acoustic characteristics such as the sound-pressure/frequency characteristic, the directional characteristic and the like are improved.

It is a further object of the invention to provide a loudspeaker in which the number of units which are used to encompass the desired sound frequency spectrum can be decreased by increasing the cross-over frequency.

It is a still further object of the invention to provide a loudspeaker with a plane vibrating diaphragm whose piston vibrating region is desirably wide and which has good acoustic characteristics.

Yet a further object of the invention is to provide a loudspeaker in which a "buzz" or rattle sound from the diaphragm is avoided.

A still further object of the invention is to provide a loudspeaker having a complex diaphragm and in which the layers of the complex diaphragm do not peel off with age.

A further object of the invention is to provide a so-called "edgeless" loudspeaker having good acoustic characteristics.

Another object of the invention is to provide a loudspeaker in which the peripheral edge of a complex diaphragm is treated to be substantially homogeneous with the remainder thereof.

SUMMARY OF THE INVENTION

According to one aspect of the present invention, a loudspeaker is comprised of a diaphragm including first and second layers sandwiching an intermediate core therebetween, the core being firmly secured to the inner surface of each layer to form a unitary structure therewith. A drive assembly causes the diaphragm to vibrate in accordance with a varying electrical signal supplied to the loudspeaker, and a support is provided for supporting the diaphragm and drive assembly. The layers are formed of materials through which the velocity of propagation of a longitudinal wave is greater than 5000 m/sec, and the core is formed of materials having a shearing elastic modulus $G_{co}$ which exceeds the value given by $$G_{co} > \frac{12\,E_f t_f (t_c + 2t_f)}{l^2}$$

where $E_f$ is the longitudinal elasticity of each of the layers,
$t_f$ is the thickness of each of the layers,
$t_c$ is the thickness of the core, and
$l$ is the diameter or length of a side of the diaphragm.

BRIEF DESCRIPTION OF THE DRAWINGS

Other objects, features and advantages of the present invention will become apparent from the following description taken in conjunction with the accompanying drawings wherein like references are used throughout and in which.

DETAILED DESCRIPTION OF THE PREFERRED EMBODIMENTS

Figure 1:
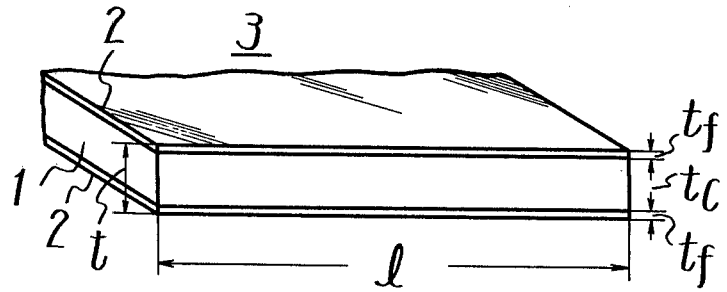
FIG. 1 is a perspective view showing, in enlarged scale, an example of a portion of a complex vibrating diaphragm which is used in the loudspeaker of the present invention.
Figure 2:
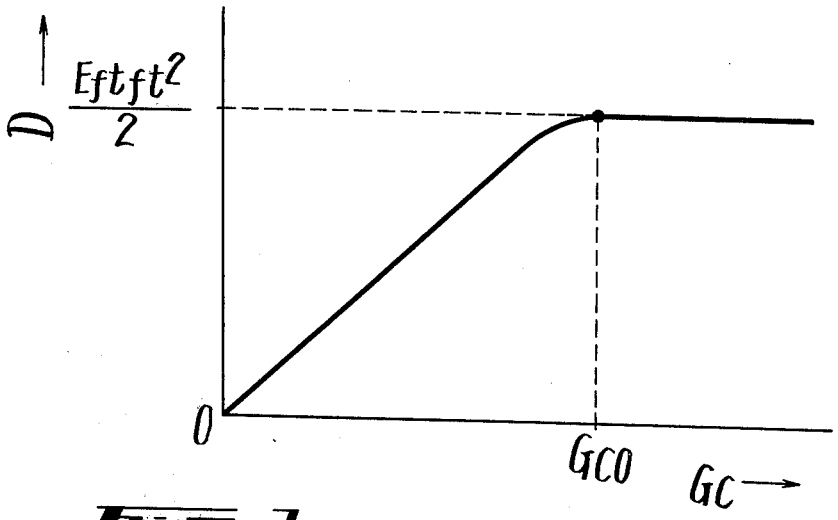
FIG. 2 is a graph showing the relation of the flexural rigidity of the complex diaphragm shown in FIG. 1 to its shearing elastic modulus.

Referring now to the drawings, FIG. 1 shows a vibrating diaphragm 3 having a total thickness $t$ and formed of a core 1 with thickness $t_c$ and layers 2 secured to both opposing surfaces of core 1, each layer having a thickness $t_f$. It may be assumed that equation (4) above represents the relation between the shearing elastic modulus $G_c$ of core 1 and the equivalent flexural rigidity D of diaphragm 3. If the longitudinal elastic modulus $E_f$ of layers 2 is constant, the relation between the flexural rigidity and shearing elastic modulus of the diaphragm is as shown in the graph of FIG. 2. FIG. 2 represents that the equivalent flexural rigidity D increases proportionally within a range where the shearing elastic modulus $G_c$ is low, and that the equivalent flexural rigidity D does not increase but, rather, is held constant when the shearing elastic modulus $G_c$ reaches a certain value $G_{co}$.

If the shearing elastic modulus $G_c$ is selected such that the longitudinal shearing elastic modulus $E_f$ of layers 2 can be sufficiently low to be neglected for that selection of modulus $G_c$, and if $G_c$ is assumed to be the certain value, then 24 $e_f t_f t$ in equation (4) can be neglected and the flexural rigidity D, derived from equation (4) in a range greater than $G_c = G_{co}$, can be expressed as:

$$D = \frac{E_f t_f t^2}{2} \tag{6}$$

Furthermore, the surface density $\sigma$ can be represented as $\sigma = \sigma_D$, $\sigma_D$ being constant, and the thickness $t_f$ of each of the layers 2 and the thickness $t_c$ of core 1 for obtaining maximum flexural rigidity D can be obtained from equations (5) and (6) and expressed by the following:

$$t_f = \frac{\sigma D}{6(\rho_f - \rho_c)} \tag{7}$$

$$t_c = \frac{2\rho_f - 3\rho_c}{3\rho_c(\rho_f - \rho_c)} \cdot \sigma_D$$

If equation (7) is substituted into equation (6) for the purpose of calculating maximum flexural rigidity $D_{max}$, then $$D_{max} = \frac{E_f \sigma D^3}{27\rho_c^2(\rho_f - \rho_c)} \approx \frac{\sigma D^3}{27} \cdot \frac{E_f}{\rho_f} \cdot \frac{1}{\rho_c^2} \tag{8}$$

The approximation on the right side of equation (8) has assumed that $\rho_f >> \rho_c$. In general, $\sqrt{E_f/\rho_f}$ represents a propagation velocity $C_f$ of a longitudinal wave. For maximum flexural rigidity, $D_{max}$ of equation (8) is selected so that the longitudinal wave propagation velocity $C_f$ of layers 2 is high and so that the density $\rho_c$ of core 1 is relatively low.

Equation (8) may be considered to describe an ideal case; but in a practical embodiment, adhesive material is used to couple or connect the respective members and thus affects many of the parameters of this equation. One effect of the adhesive material is to increase the surface density $\sigma$, so that the surface density $\sigma_D$ in equation (8) actually is 30% less for the ideal case than for the practical embodiment. Further, since there is a limit to the density $\rho_c$ of core 1 or, as shown in the graph of FIG. 2, since the shearing elastic modulus $G_c$ of core 1 should not vary by much from the constant shearing elastic modulus $G_c$, the density $\rho_c$ is set at about 25 $Kg/m^3$ which is the lowest value for a practical core material. If frequency $f_{0,1}$ of the divided vibration frequencies expressed by equation (1) is assumed to be about 1000Hz as the critical value for obtaining non-directivity, then the longitudinal wave propagation velocity $C_f$ is calculated to be about 4160 m/sec. It is necessary to take into account differences in the thickness $t_f$ of layers 2, so that the longitudinal wave propagation velocity $c_f$ of layers 2 should be about 5000 m/sec.

As may be apparent from equation (4) and from FIG. 2, the shearing elastic modulus of core 1 must be balanced with the flexural rigidity. This point of balance is the constant shearing elastic modulus $G_{co}$. At balance, modulus $G_{co}$ satisfies the equation $2G_c l^2 = 24\ E_f t_f t$ which is derived from the denominator of the right side of equation (4). Hence, $G_{co}$ is expressed as follows:

$$G_{co} = \frac{12\,E_f t_f}{l^2} \tag{9}$$

Thus, when the size of the diaphragm and the material of the layers are selected, $t_f$ and $t_c$ can be calculated from equation (7) with the assumption that the core density $\rho_c$ is constant, modulus $G_{co}$ can be calculated from equation (9), and the quality of the material needed to satisfy these calculated values as well as to determine the modulus can be easily selected and determined.

As an example of the foregoing, an aluminum alloy sheet with a thickness of 30μ is used as layers 2 of FIG. 1, and a honey-comb made of aluminum alloy with a thickness of 12 mm is used as core 1. In this example, the shearing elastic modulus $G_c$ of core 1 is $1.5 \times 10^8$ N/m$^2$ and the surface density $\sigma_D$ is 0.46 Kg/m$^2$ (with the adhesive agent being taken into account). The thickness $t_f$ of layers 2 and the thickness $t_c$ of core 1 are chosen to be 28.8μ and 11.9 mm from equation (7). The propagation velocity of a longitudinal wave in layers 2 is 5120 m/sec from equation (8), and the flexural rigidity D, as determined by equation (8), is about 153 N. m. Accordingly, the divided vibration frequency $f_{0,1}$, as determined by equation (1), is about 1170 $H_z$.

Figure 3:
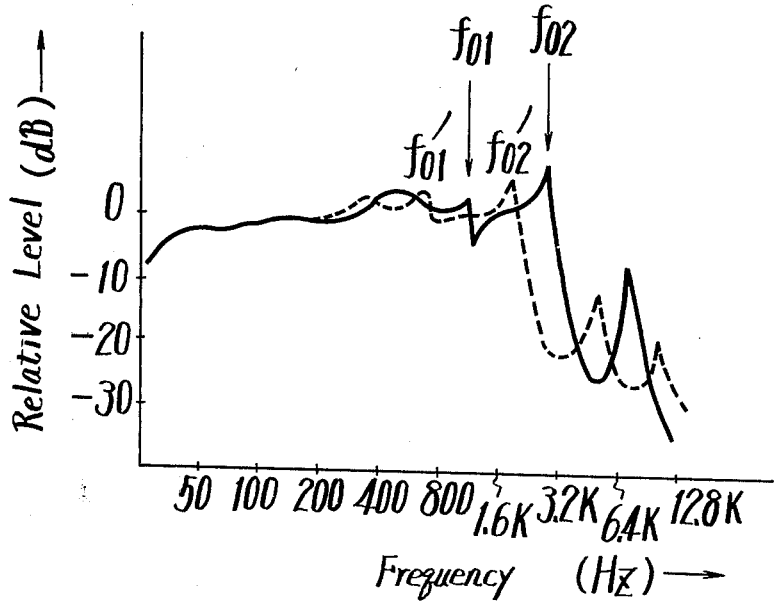
FIG. 3 is a graph comparing the sound-pressure/frequency characteristics of the diaphragm shown in FIG. 1 and a prior art diaphragm.

FIG. 3 is a graphical representation of the sound-pressure to frequency characteristic of the above example of this invention, as obtained by measurements (solid line curve). From such measurements, $f_{0,1}$ is about 1050 $H_z$, although this value varies slightly if the thickness of the diaphragm component varies. In FIG. 3, the broken curve represents the same sound-pressure/frequency characteristics for a prior art device.

The above-described material and plane shape of the complex diaphragm of the invention are merely illustrative. It is intended that the material and shape of the diaphragm need not be limited solely to the above example.

The foregoing example can be used in a mid-range speaker and in a tweeter speaker. These speakers have rather small sound radiation areas. This means that it is not sufficient merely to reduce the surface density of the diaphragm; rather, the layers should be selected such that the longitudinal wave propagation velocity therein is more than 5000 m/sec.

Figure 4:
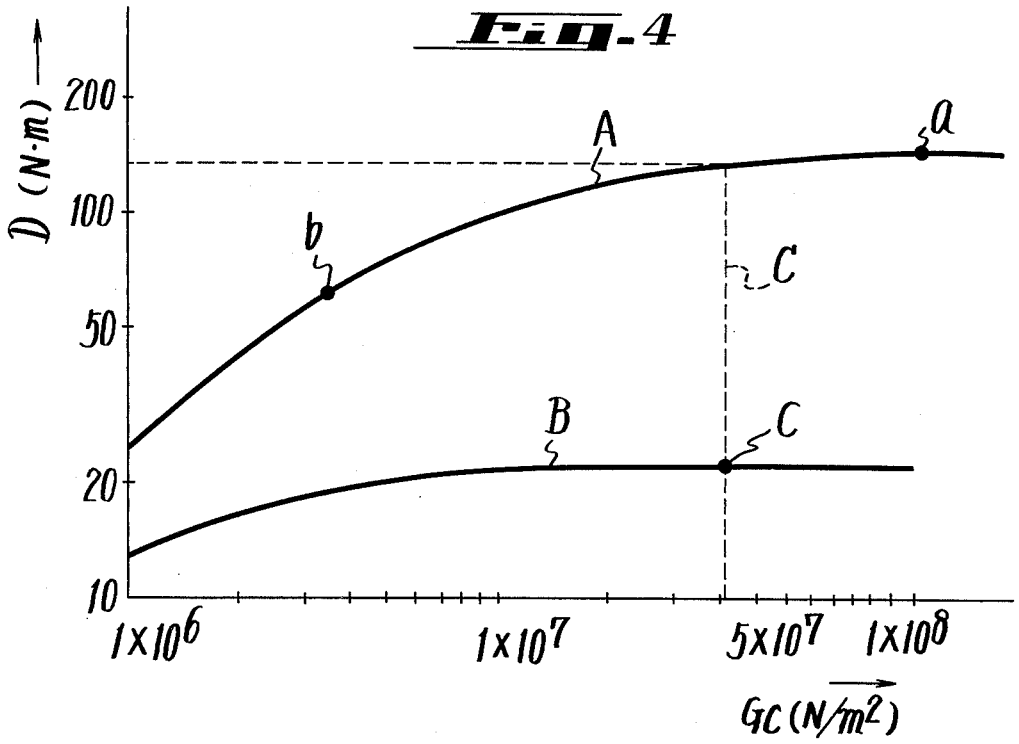
FIG. 4 is a graphical comparison of the relation between the flexural rigidity and the shearing elastic modulus of the diaphragm shown in FIG. 1 and that of the prior art diaphragm.

FIG. 4 is a graphical representation of the shearing elastic modulus $G_c$ of the core with respect to the flexural rigidity D of the complex diaphragm, with the longitudinal elastic modulus of the layers as a parameter. This representation is for a prior art example, in which the core is made of styrene foam and each layer is made of aluminum alloy, another prior art example, in which the core is made of paper honey-comb and each layer is made of paper liner, and an example according to the invention, in which the core is made of aluminum honey-comb and each layer is made of aluminum alloy. Curve A represents the examples wherein the aluminum alloy is used to form the layers and curve B represents the example wherein paper is used to form the layer. Point *b* on curve A is obtained from the first prior art example and point *c* on curve B is obtained from the second prior art example, respectively. For the example according to the present invention in which the complex diaphragm is formed of the aluminum honey-comb core and aluminum alloy layers, point *a* on curve A is obtaned, which point *a* is positioned to the right side of dotted line C which intersects curve B at a vertical projection from point *c*.

Figure 5:
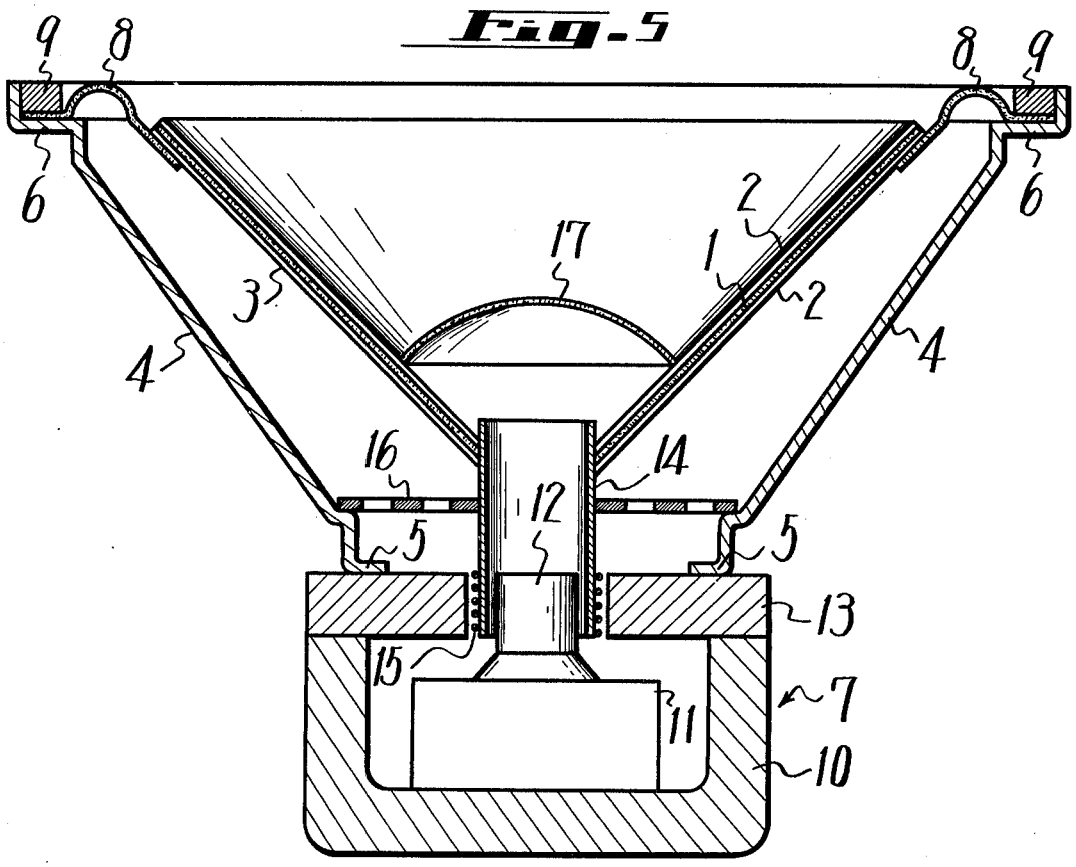
FIG. 5 is a cross-sectional view showing one example of a loudspeaker according to the invention.

One example of a loudspeaker according to the present invention, in which the above-mentioned vibrating diaphragm is used, is shown in FIG. 5. The illustrated loudspeaker is a cone-shaped dynamic speaker having a frame 4 made of, for example, a die casted alloy and shaped generally as a cone. The small diameter end portion of frame 4 forms a portion 5 for attaching to a magnetic circuit unit, and the large diameter end portion of frame 4 is provided with a flange 6. Magnetic circuit unit 7 is attached to portion 5 by, for example, screws, and diaphragm 3, which is cone-shaped, is attached to flange 6 through an edge securing member 8 made of, for example, rubber, urethane or the like. Edge securing member 8, sometimes referred to merely as an edge member, is disposed about the outer periphery of diaphragm 3 and is capable of vibrating within frame 4. In this embodiment, edge member 8 is attached to flange 6 by a gasket 9.

Magnetic circuit unit 7 has a U-shaped yoke 10, a magnet 11 located within the yoke 10, a center pole 12 disposed on magnet 11 and extending in the upward direction, a yoke plate 13 located about the center pole 12 to cover the yoke 10 yet leave an air gap therein, a bobbin 14 disposed in the air gap and fixed to the inner edge of diaphragm 3 and surrounding the pole 12 to define another gap with the pole, and a voice coil 15 wound on bobbin 14 within the magnetic gap between the bobbin and yoke plate 13.

A flexible damper member 16 is provided between bobbin 14 and the attaching portion 5 of frame 4. As one example, the flexible damper is a plate to determine the position of bobbin 14 in the magnetic circuit. Further, a cap 17 is provided to be attached to diaphragm 3 above bobbin 14. Consistent with the previously explained example of the complex diaphragm, diaphragm 3 is formed of core 1 sandwiched between layers 2.

In the speaker shown in FIG. 5, the contact portion between diaphragm 3 and edge member 8 and the contact portion between the diaphragm 3 and bobbin 14 are specially treated because of the specific construction of the diaphragm, as will be described below.

Figure 6:
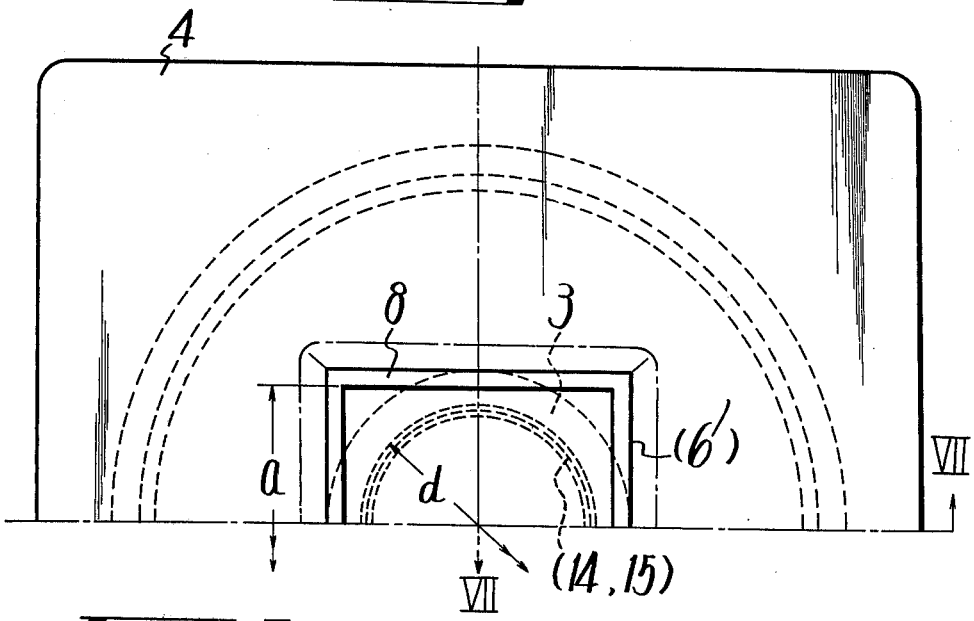
FIG. 6 is a front view showing a portion of a second example of a loudspeaker according to the invention.
Figure 7:
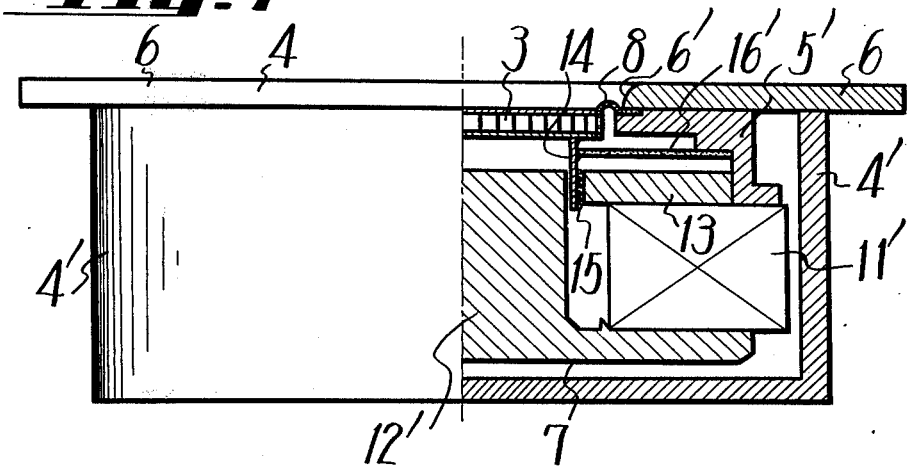
FIG. 7 is a cross-sectional view taken along the line VII—VII on FIG. 6.

Another example of a loudspeaker according to the invention is shown in FIGS. 6 and 7. The speaker shown herein is a dynamic speaker in which plane vibrating plates are used as the vibrating diaphragm, these plates being of a square shape. The illustrated speaker has a frame 4 made of a die casted alloy whose front portion is formed with a wide flange 6 and whose rear or depending portion (FIG. 7) is formed as a frame 5' to which a magnetic circuit unit of known construction is attached. A flexible edge member 8 is gripped between an inner edge 6' of flange 6 and frame 5' so as to attach flat complex diaphragm 3 to frame 4.

The magnetic circuit attached to frame 5' is provided with a pole member 12' whose cross-section is an inverse L-shape, a ring-shaped magnet 11' mounted on pole member 12', and a plate 13 mounted on the upper surface of magnet 11' to form a magnetic gap between the plate and the center projection of pole member 12'. A bobbin 14 is attached to the diaphragm 3 and a voice coil 15 is wound thereon to be positioned within the magnetic gap. Bobbin 14 also is positioned by a damper 16' attached to frame 5'. A cylindrical cover 4', which also forms a part of frame 4, covers the aforedescribed elements. The magnetic circuit itself is well known.

An explanation now will be given as to why the square-shaped plane diaphragm is used as the vibrating diaphragm in FIGS. 6 and 7. The circular plane plate and square plane plate have different physical characteristics, and the square plane plate is more effective than the circular plane plate. For example, with respect to directivity, when the frequency at which the sound-pressure becomes low is measured, this sound-pressure is at −10 dB when measured at 30° deviation from the front axis and is at −3 dB when measured at 60° from the axis. For a square-shaped diaphragm with the same area, the sound-pressure measurements are about 13% higher than for a circular-shaped diaphragm. As a numerical example, for a circular diaphragm whose diameter is 34 mm, the above frequency at which the sound-pressure becomes low is about 10 $KH_z$. For a square diaphragm with the same area, i.e., 30 mm × 30 mm, the above frequency is about 11.3 $KH_z$. This means that the range of directivity can be widened when a square-shaped diaphragm is used.

For divided vibration, the diameter of the voice coil should be selected to remove the lowest mode in the axis symmetrical divided vibrations, thereby presenting the next higher mode. If a square-shaped diaphragm and a circular-shaped diaphragm are formed of the same materials, the frequency at which the next higher mode is established is somewhat higher for the square diaphragm than for the circular diaphragm. Also, the piston vibration region is widened for the square diaphragm.

Optimum values for improved frequency characteristics as a function of the size of diaphragms of the plane plate type and of the diameter of the driving voice coil, as determined by analysis and testing, now will be described. It is assumed that the periphery of a square plate is free and the length of one side is $a$. Since the lowest mode of its axis symmetrical divided vibrations is the (0,2 + 2,0) mode, which is provided by the degeneration of modes (0, 2) and (2, 0), the shape of its node is a circle and the diameter of this circular node is the same as that of the circular node which occurs for mode (0, 1), the latter being produced on the circular vibrating diaphragm having the same area as the square vibrating diaphragm. That is, the diameter of the circular node of the square diaphragm is $0.680 \times 2a/\sqrt{\pi} \approx 0.767a$ which is the same as the diameter of the circular node of the circular diaphragm having a diameter of $2a/\sqrt{\pi}$. Therefore, if the square diaphragm is driven by a voice coil whose diameter is the same as that of the circular node, the mode (0,2 + 2,0) will be suppressed. However, the position of the circular node moves due to the mass of the voice coil.

Let the ratio between the mass of the total vibrating system including the air load mass and the mass of the drive system including the total mass of the voice coil, coil bobbin and the like be represented as $\mu$:

$$\mu = \frac{\text{Mass of Drive System}}{\text{Equivalent Mass of Vibrating System}}$$

If $\mu$ is zero, the diameter $d$ of the circulate node is $0.767a$, but as $\mu$ increases diameter $d$ increases. If the approximate value of the diameter $d$ is determined from experiments, the following is obtained.

$$d \approx (0.767 + 0.375\mu)a \qquad (10)$$

Thus, if the voice coil having the diameter expressed by equation (10) is used to drive the diaphragm, the lowest divided vibration of the axis symmetry is suppressed. Hence, it becomes important to keep the drive position accurately if the diaphragm is to be less of a source of loss. However, since there are losses at the edge and other locations, a tolerance of about ±5% for diameter $d$ is available in equation (10), and no disturbance appears in the frequency characteristic within this tolerance range.

Figure 8:
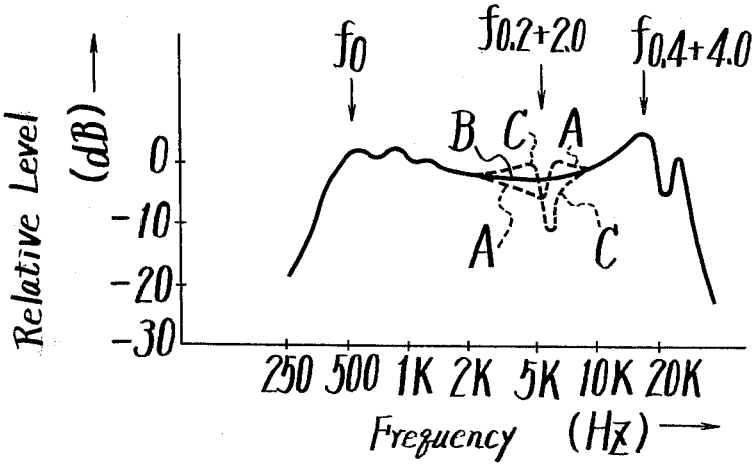
FIG. 8 is a graph showing the relation between the relative sound level and audio frequency of the loudspeaker shown in FIGS. 6 and 7 as a function of the diameter of the voice coil thereof.

FIG. 8 is a graphical representation of the test results of the frequency characteristics if the diameter of the voice coil is changed. These results have been obtained for the following parameters:

Layers: made of aluminum alloy and having thickness of 30$\mu$.

Core: made of aluminum honey-comb of 4′ and having the cell size of 3/16.

Size of diaphragm: 46 mm × 46 mm × 4′.

Weight of diaphragm: 0.9 gr.

Curve A (FIG. 8): Voice coil diameter 38 mm, Mass of drive system 0.43 gr ($\mu$=0.249), optimum voice coil diameter by calculation 39.6 mm.

Curve B (FIG. 8): Voice coil diameter 40 mm, Mass of drive system 0.45 gr ($\mu$=0.260), optimum voice coil diameter by calculation 39.8 mm.

Curve C (FIG. 8): Voice coil diameter 42 mm, Mass of drive system 0.47 gr ($\mu$=0.272), optimum voice coil diameter by calculation 40.0 mm.

In FIG. 8, $f_{0,2+2,0}$ is frequency at which the (0,2 + 2,0) mode appears. Curve B is drawn for practically the optimum size of the voice coil, and the (0,2 + 2,0) mode is suppressed therewith. In curve A, the voice coil diameter is smaller than its optimum value and the effect of the (0,2 + 2,0) mode appears on the frequency characteristic in the order of trough to peak. In curve C, the voice coil diameter is greater than its optimum value, so that the effect of the (0.2 + 2,0) mode appears in the order of peak to trough.

Figure 9:
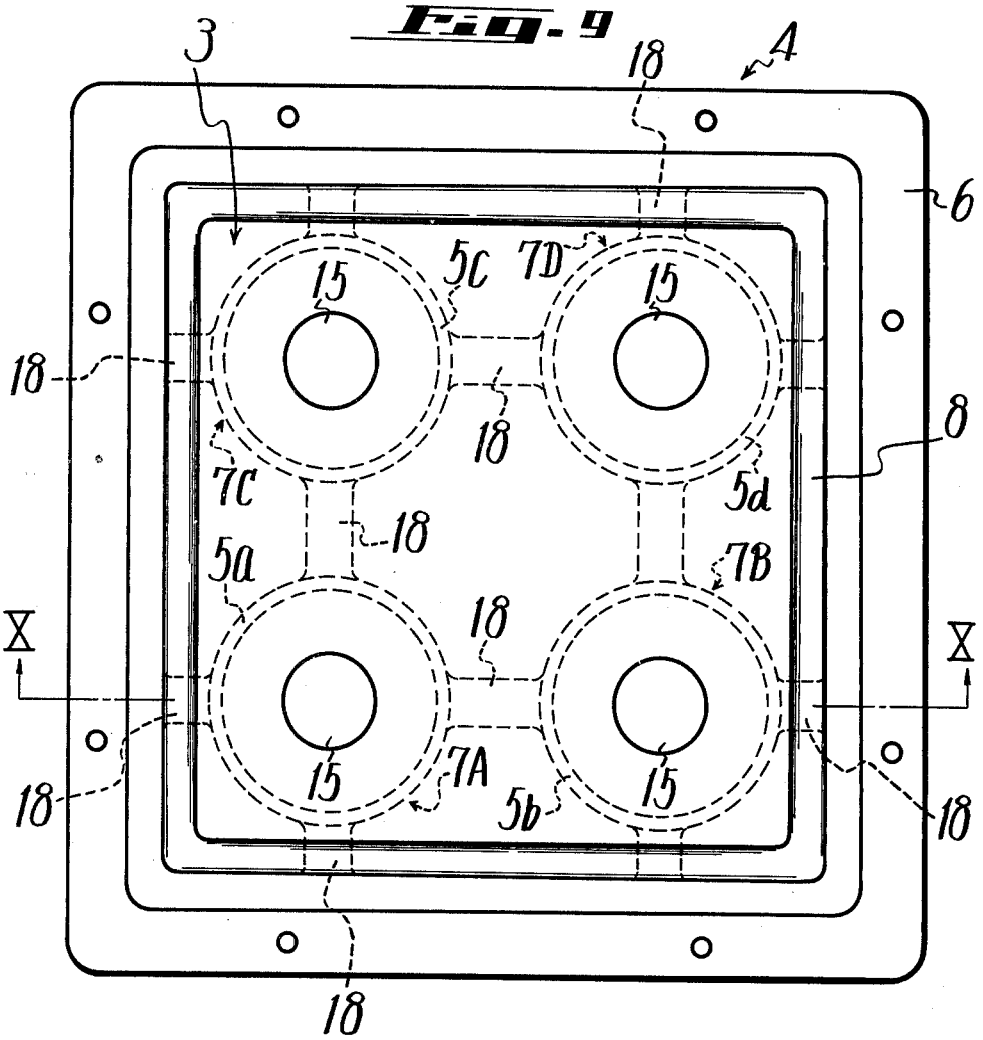
FIG. 9 is a front view showing a third example of a loudspeaker according to the invention.
Figure 10:
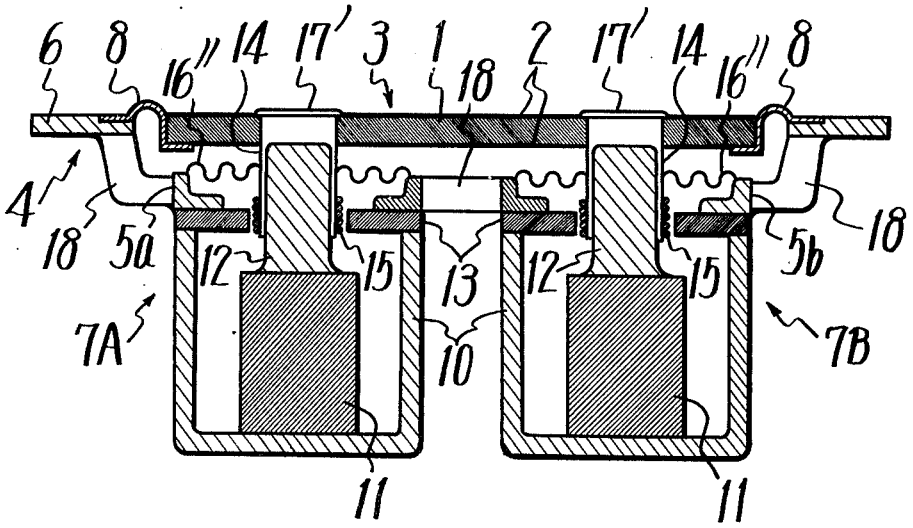
FIG. 10 is a cross-sectional view taken along line X—X in FIG. 9.

A further example of a loudspeaker according to the invention is shown in FIGS. 9 and 10. This is a dynamic speaker of a plane vibrating-plate multi-point drive type. The speaker of this example includes a frame 4 made of die casted alloy and has the square contour. The frame is provided with a flange 6 along its outer periphery, and four attaching portions 5 (5*a*, 5*b*, 5*c* and 5*d*) are integrally attached to the back side of flange 6 through a plurality of ribs 18 to receive respective magnetic circuit units. Magnetic circuit units 7 (7A, 7B, 7C and 7D) are attached to portions 5 by screws or the like. The complex vibrating diaphragm 3, which may be constructed as described above, is attached to flange 6 through an edge member 8 made of, for example, rubber, urethane or the like so as to be capable of vibrating.

In the embodiment of FIGS. 9 and 10, the construction of each of the magnetic circuits units 7 is substantially the same as the magnetic circuit unit used in the example of FIG. 5. A flexible damper 16″ is a circular corrugated damper and is provided for the same purpose as described above with respect to damper 16. Each magnetic circuit unit 7 is provided so that the center axis of bobbin 14 in its vibration direction intersects the node of the divided vibration generated in the diaphragm 3 or is positioned near the node to minimize divided vibration caused thereby. An open end of each of bobbins 14 at diaphragm 3 is covered by a cap 17′.

Figure 11A:
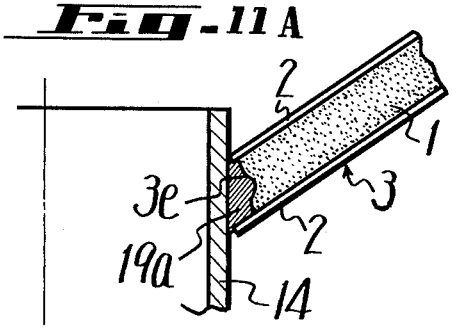
FIGS. 11A, 11B and 11C are respective cross-sectional views showing different coupling mechanisms by which the diaphragms of the invention are coupled to their voice coils in loudspeakers.
Figure 11B:
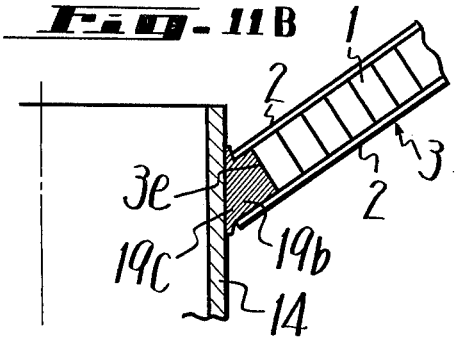
Figure 11C:
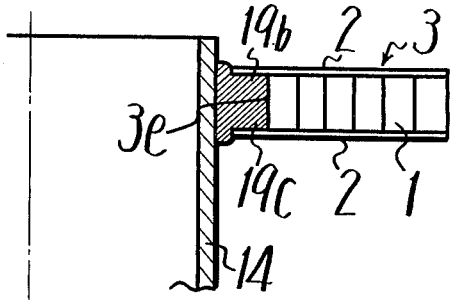

Referring now to FIGS. 11A–11C, the manner in which diaphragm 3 and voice coil bobbin 14 are connected, and the manner in which the outer peripheral end surface of diaphragm 3 is treated are shown. Core 1 of diaphragm 3 has an end surface 3e which, as shown in FIG. 11A, may not always be flat or planar but, rather, may be irregular. Thus, when the diaphragm is attached to bobbin 14, it is necessary to add a charge of adhesive agent into the gap between the irregular end of core 1 and the bobbin to provide a uniform, planar end surface. However, the charge of adhesive agent causes a substantial increase in the weight of diaphragm 3 which is driven by voice coil 15, and hence the desirable audio characteristics of the diaphragm 3 are deteriorated. Further, if the outer or free end surface of the core (not shown in FIG. 11A) also is irregular, a buzz or rattle sound is apt to be produced when the diaphragm vibrates, and this also tends to deteriorate the characteristics of the diaphragm. Also, because of such irregular end surfaces, the layers which are secured to both opposing surfaces of the core will peel off with the passage of time.

Figure 12A:
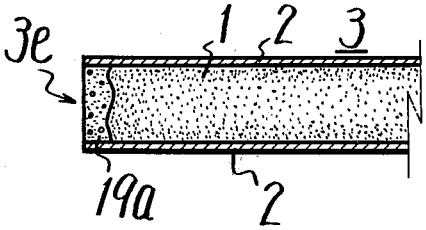
FIGS. 12A and 12B are respective cross-sectional views showing the outer peripheral ends of different diaphragms used in the loudspeaker according to this invention.

Therefore, in the loudspeaker of this invention, end surface 3e of core 1 is treated by an adhesive agent 19a formed of a rubber mixed with, for example, glass beads or bubbles having a grain size of 100μ to 130μ, as shown in FIGS. 11A and 12A. When diaphragm 3 is attached to bobbin 14, the adhesive agent 19a is charged into the gap between the end surface 3e of core 1 and the bobbin to bind both together firmly and to bind layers 2 to both opposing surfaces of the core.

Preferred examples of the adhesive agents used in the embodiments of FIGS. 11A–11C are as follows.

19a (FIG. 11A): Mixture of a rubber adhesive agent with glass beads having a grain side of 100μ to 130μ with a weight ratio of 1 : 1;

19b (FIGS. 11B and 11C): Mixture of an epoxy adhesive agent with glass beads having a grain size of 100μ to 130μ with a weight ratio of 7 : 3;

19c (FIGS. 11B and 11C): Mixture of alarudite FW 650 (Trade Name), an epoxy adhesive agent, a hardening agent HY 650 and a foam agent DY 650 in a weight ratio of 100 : 33 : 1, foaming being obtained by a heating process.

In FIG. 11B, core 1 of diaphragm 3 is a honey-comb plate. Adhesive agents 19b and 19c can be used to secure the diaphragm to bobbin 14. A suitable amount of adhesive agent 19c is charged into the clearance between end surface 3e and bobbin 14, and then the end surface portion, or the entire diaphragm, is heated to make agent 19b foam so as to bind both layers to the honey-comb core at the end surface of the core, and finally to bind the diaphragm to the bobbin.

FIG. 11C shows a plane-plate type complex diaphragm 3, including honey-comb core 1, secured to bobbin 14. In this embodiment, the same adhesive agent as used in FIG. 11B can be employed.

When the foregoing treatment is used at the outer or free end of diaphragm 3, as shown in FIG. 12A, the irregular outer end surface 13 of the diaphragm, which may be analogous to the irregular inner end surface 3e, is subjected to a shaping process by, for example, adhesive agent 19a. That is, agent 19a is coated on or charged into end surface 1e to bind the core 1 to both layers 2 at that end portion, and then the end of the diaphragm is treated to be a uniform end surface by any conventional suitable working method.

Figure 12B:
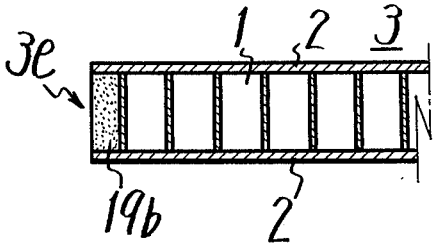

In the embodiment of FIG. 12B, complex diaphragm 3 includes a honey-comb core 1, and adhesive agent 19b is used to treat the free end surface 13. For this treatment, agent 19c is charged into the gap at the outer end surface, and then the end surface portion, or the entire diaphragm, is heated to foam agent 19b so as to bind the honey-comb core and the layers to both opposing surfaces of the core. Finally, the end surface of diaphragm 3 is shaped to be flat and uniform.

Agents 19a, 19b and 19c are used to make the inner and outer edge portions of the diaphragm substantially homogenous with the remainder thereof. Thus, the edge portions will not vibrate differently from other portions; and the frequency characteristics of the loudspeaker, and especially the high frequency band, are not deteriorated. Further, another advantage is that the total mass of the vibrating diaphragm is reduced.

As may be appreciated, the embodiments of FIGS. 11A–11C and 12A–12B can be applied to virtually any loudspeaker which comprises a complex vibrating diaphragm, such as a cone-shaped, plane-plate type and the like. Accordingly, with the present invention, the irregular end surfaces of the diaphragm can be shaped properly, and contact between the diaphragm and the coil bobbin can be made firmly. Additionally, the total weight of the vibrating diaphragm can be reduced, so that the load to the voice coil drive is reduced, and hence the characteristics of the loudspeaker will be favorably improved.

If the end-treatments discussed with respect to FIGS. 11A–11C and 12A–12B are applied to an edgeless speaker, improved vibration characteristics will result. In the loudspeaker embodiments shown in FIGS. 5, 6, 7, 9 and 10, the diaphragm of the loudspeaker is supported by a frame through an edge member 8 along the periphery of the diaphragm. In some instances, however, the edge member has a deleterious affect on the frequency characteristics of the loudspeaker; and hence the sound quality of the speaker is degraded.

In order to avoid the above defect, there is proposed an edgeless speaker in which a uniform clearance is provided between the outer periphery of the diaphragm and the frame. This clearance, or gap, produces a certain value of acoustic impedance. Such acoustic impedance is necessary to maintain the low frequency band; and to establish a relatively high acoustic impedance, the length $l$ of clearance C (FIG. 13A) should be as long as possible and also the clearance should be as small as possible. However, if clearance C is too small, the inclination and eccentricity of the diaphragm may result in contact between the diaphragm and the frame. Thus, in general, it is considered advantageous that the length of the clearance be long so that the clearance is not less than the critical value.

Figure 13A:
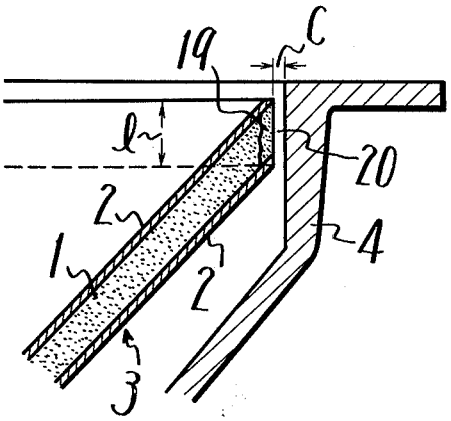
FIGS. 13A and 13B are respective cross-sectional views showing further examples of the loudspeaker according to the invention.
Figure 13B:
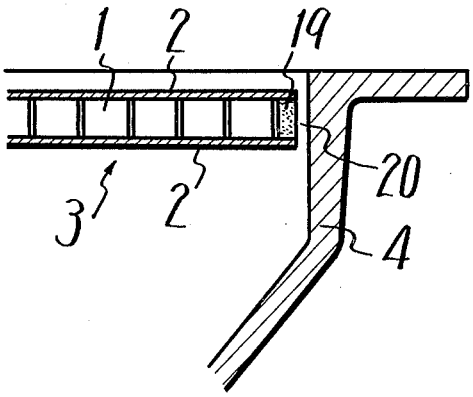

Examples of edgeless speakers incorporating features of the present invention are shown in FIGS. 13A and 13B. In these examples, the loudspeaker generally is the same as described previously. Hence, only the portion near the outer periphery of the vibrating diaphragm 3 is shown. It is appreciated that the usual magnetic circuit is attached to frame 4 and that the voice coil is wound on the voice coil bobbin which, in turn, is attached to the diaphragm. Also, the bobbin and diaphragm are held at a predetermined position by the damper.

The adhesive agent 19, which may be of the type described above, such as a rubber mixed with glass beads or with a resin, or which may include a foaming agent so that the adhesive agent can be foamed by heating, by chemical treatment and the like, is provided on the outer peripheral end surface of diaphragm 3 to shape the end surface, as described previously. This provides a uniform gap or clearance 20 between frame 4 and the outer peripheral surface of diaphragm 3, and therefore provides a desired acoustic impedance. The total mass of the complex diaphragm is selected to be small, its thickness is about 10 mm, and its flexural rigidity is sufficiently high. Thus, the loudspeaker can be edgeless, and clearance 20 is maintained between the outer peripheral surface of the diaphragm and frame 4 without using an reinforcing material. Furthermore, because of the uniform end surface of the diaphragm, there is little likelihood that the diaphragm will contact the frame upon driving. Therefore, the edgeless speaker shown in FIG. 13A can perform with the excellent characteristics inherent to an edgeless speaker.

Another example of an edgeless speaker utilizing the features of this invention is shown in FIG. 13B. This loudspeaker is of the plane-plate type, wherein core 1 of diaphragm 3 is made of a honey-comb plate whose outer peripheral surface is subjected to the shaping treatment described above with respect to FIGS. 11A–11C, 12A–12B and 13A. Hence, the embodiment of FIG. 13B achieves the same advantges as the embodiment of FIG. 13A. That is, the edgeless speakers shown in FIGS. 13A and 13B efficiently achieve the excellent characteristics inherent in edgeless speakers, and also achieve the good characteristics of the complex vibrating diaphragm in accordance with the present invention.

The effects achieved by the end surface treatment described above, both for edge-secured and edgeless speakers, are particularly advantageous for plane-plate type speakers.

Figure 14A:
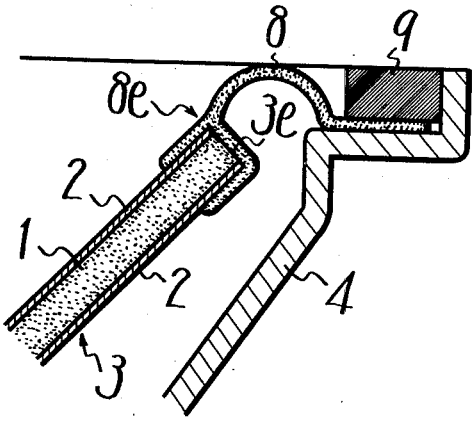
FIGS. 14A, 14B, 14C and 14D are respective cross-sectional views showing different examples of edge members used in the loudspeaker of the present invention to connect the diaphragm to the frame of the loudspeaker.
Figure 14B:
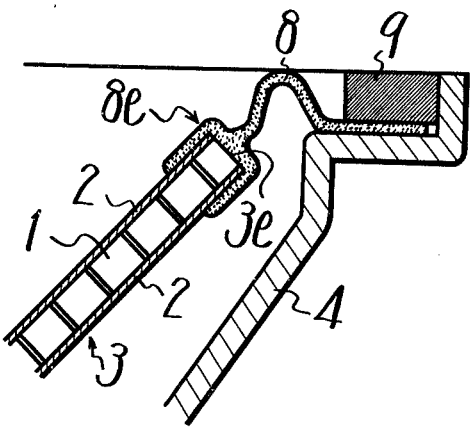
Figure 14C:
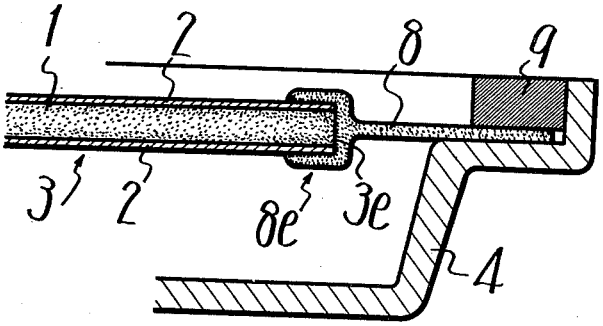

Other examples of treating the end surface of the diaphragm according to an advantageous feature of this invention now will be described. In these examples, the aforementioned adhesive agents of rubber or resin mixed with glass beads are not needed; but the same effect as achieved previously can be attained. In FIGS. 14A, 14B and 14C, one end of edge member 8 (made generally of foam urethane, rubber or the like) is formed to be U-shaped and serves as a gripper member 8*e* into which the end edge of complex diaphragm 3 is pressed so that the end surface 3*e* thereof is in contact with the bottom surface of the gripper member. The contact portions between gripper member 8*e* and diaphragm 3 may be bound by an adhesive agent, such as a resin. In this manner, the outer peripheral portion of complex diaphragm 3, including its end surface 3*e*, is covered or gripped by gripper member 8*e*.

In FIG. 14B, the loudspeaker is cone-shaped, core 1 is made of a honey-comb plate, and edge member 8 is provided with a corrugation and, moreover, is attached to the center of gripper member 8*e*.

Figure 14D:
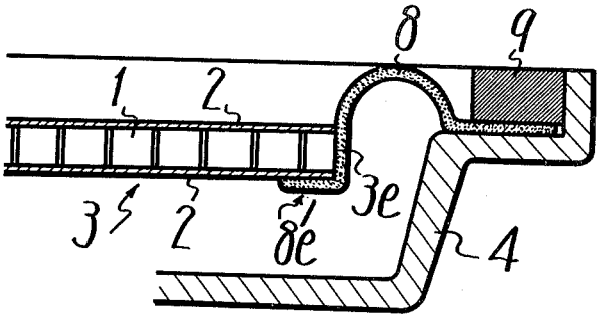

FIGS. 14C and 14D show embodiments wherein the complex diaphragm is used in a plane-plate type speaker. In FIG. 14C, gripper member 8*e* is U-shaped to receive the end portion of diaphragm 3, including its end surface 3*e*. In FIG. 14D, gripper member 8*e* is an L-shaped support 8*e*′ which is in contact with both end surface 3*e* and the lower surface of diaphragm 3.

By reason of the present invention, those defects attending prior art speakers using complex vibrating diaphragms are substantially avoided. The present invention improves the characteristics of loudspeakers which employ complex diaphragms and prevents the peeling off of the layers from the core of the diaphragm as the speaker ages.

It will be apparent that many modifications and variations can be made by one of ordinary skill in the art without departing from the spirit or scope of the present invention. It is intended that the appended claims be interpreted to include such modifications and variations.

What is claimed is:

1. A loudspeaker comprising:

a diaphragm including first and second layers and a core sandwiched between said layers, said core being secured to an inner surface of each of said layers to form a unitary structure therewith;

means for vibrating said diaphragm in accordance with a varying electrical signal supplied thereto; and support means for supporting both said diaphragm and said means for vibrating; the improvement wherein each of said layers is formed of materials through which the velocity of propagation of a longitudinal wave is greater than 5000 m/sec. and wherein said core is formed of materials having a shearing elastic modulus $G_{co}$ which exceeds the value $$G_{co} > \frac{12\, E_f t_f (t_c + 2t_f)}{l^2}$$

where $E_f$ is the longitudinal elasticity of each of said layers, $t_f$ is the thickness of each of said layers, $t_c$ is the thickness of said core, and $l$ is the length across the surface of said diaphragm.

2. A loudspeaker according to claim 1, wherein said means for vibrating include at least one drive assembly comprised of magnet means defining an air gap having a magnetic field therein, voice coil means attached to said diaphragm and having a bobbin and a voice coil wound around said bobbin, said voice coil being disposed in said magnetic field and means for providing said voice coil with said varying electrical input signal, and said support means includes a frame member and damping means for supporting said bobbin relative to said frame member.

3. A loudspeaker according to claim 2, wherein said diaphragm is formed as a flat plate.

4. A loudspeaker according to claim 2, wherein said diaphragm is formed as a flat square whose length $l$ is the length of one side of said diaphragm, and said bobbin is connected to said diaphragm to be substantially coaxial therewith, the diameter of said bobbin being approximately equal to $d$, wherein $$d = [0.767 + 0.375\,(Mv/Me\,]a$$

where $Mv$ is the mass of the driving system including at least said voice coil and said bobbin, $Me$ is the equivalent mass of the vibrating system including said driving system, said diaphragm and the air load, and $a$ is the length of one side of said diaphragm.

5. A loudspeaker according to claim 2, wherein said diaphragm has an opening through said first and second layers and through said core, and said bobbin is attached to the surface of said opening by an adhesive comprised of an adhesive agent mixed with glass bubbles.

6. A loudspeaker according to claim 5 wherein said adhesive agent is rubber material.

7. A loudspeaker according to claim 5 wherein said adhesive agent is an epoxy adhesive agent.

8. A loudspeaker according to claim 2 wherein said diaphragm has an opening through said first and second layers and through said core, and said bobbin is attached to the surface of said opening by an adhesive including a foaming agent.

9. A loudspeaker according to claim 2, wherein said support means further includes an edge member for connecting the outer perimeter of said diaphragm to said frame.

10. A loudspeaker according to claim 9 wherein said edge member includes a portion connected to one side of said diaphragm and to an exposed surface of at least one layer.

11. A loudspeaker according to claim 10 wherein said portion of said edge member is a gripper member for gripping said diaphragm therebetween.

12. A loudspeaker according to claim 1, wherein said diaphragm is of a conical shape having a center hole, said bobbin extending into said center hole and being connected thereat to said diaphragm.

13. A loudspeaker according to claim 1, whereat at least the outer peripheral edge surface of said diaphragm is coated with an adhesive agent mixed with a material selected from the group consisting of glass beads and a foam adhesive agent.

14. A loudspeaker according to claim 13 wherein the outer peripheral edge surface of said diaphragm is free to vibrate and is unconnected from said support means.

* * * * *